United States Patent [19]

Cosmos et al.

[11] Patent Number: 4,457,576

[45] Date of Patent: Jul. 3, 1984

[54] ONE PIECE METAL SHIELD FOR AN ELECTRICAL CONNECTOR

[75] Inventors: Pete Cosmos, Mechanicsburg; Brian D. Stephenson, Camp Hill, both of Pa.

[73] Assignee: AMP Incorporated, Harrisburg, Pa.

[21] Appl. No.: 450,844

[22] Filed: Dec. 17, 1982

[51] Int. Cl.[3] ..... H01R 13/648

[52] U.S. Cl. ..... 339/143 R; 29/857; 29/863; 29/882; 174/35 C; 339/141

[58] Field of Search ..... 339/136 R, 138, 141, 339/143 R, 156 R, 177 R, 177 E, 218 M, 276 R, 208, 210, 14 R; 179/35 C; 29/857, 861, 863, 876, 882

[56] References Cited

U.S. PATENT DOCUMENTS

| | | | |
|---|---|---|---|
| 3,101,229 | 8/1963 | Yopp | 339/59 |
| 3,329,925 | 7/1967 | Johnson et al. | 339/91 |
| 3,744,128 | 7/1973 | Fisher et al. | 339/143 R X |
| 3,876,276 | 4/1975 | Ayer | 339/156 R X |
| 3,879,099 | 4/1975 | Shaffer | 339/99 R |
| 4,062,616 | 12/1977 | Shaffer et al. | 339/99 R |
| 4,192,571 | 3/1980 | Strautz | 339/103 M |
| 4,200,350 | 4/1980 | Zimmerman | 339/91 R |
| 4,236,779 | 12/1980 | Tang | 339/143 R |
| 4,415,223 | 11/1983 | Asick | 339/143 R X |

*Primary Examiner*—Eugene F. Desmond
*Attorney, Agent, or Firm*—Russell J. Egan

[57] ABSTRACT

A one piece metal stamping forming an RF-EMI shield for an electrical connector has a central face portion and a pair of mating shell portions connected by respective bights to opposite sides of the face portion. The face portion is profiled to conform to the connector to be shielded and has an opening exposing the connector mating face. The shell portions have depending peripheral walls which overlap to enclose the rear portion of the connector and conductors extending therefrom. The subject shield is particularly suitable for electrical connectors which are overmolded with an insulative layer.

17 Claims, 6 Drawing Figures

ONE PIECE METAL SHIELD FOR AN ELECTRICAL CONNECTOR

The present invention concerns a one piece metal stamping forming a metal shield to substantially completely enclose an electrical connector to provide RF-EMI shielding as well as a ground path for cable shielding.

The recent growth of the electronics industry has caused a number of problems associated directly with the growth. The large number of electronic devices currently available are often in closely spaced relationship which sometimes can cause problems when the radio frequency and electro-magnetic interference generated by one such device is absorbed by a neighboring device. This can cause erroneous generation of information with the second device and/or other undesirable results. The increasing number of electronic devices generating RF and EMI have caused the enactment of a number of requirements and regulations aimed at restricting the amount of interference that is generated by a many of these devices. This is generally handled by requiring the devices to be encased in some kind of a shielding.

There are many well known metal shields that are used in association with electronic devices and electrical connectors. An example may be found in U.S. Pat. No. 3,101,299 which shows a typical connector of the type known as a sub-miniature D. It will be seen that the insulating block carrying the terminals is enclosed in a metal housing. While this particular one is not shown terminating a shielded cable, this would clearly require only a minor modification to attach the cable shield to the metal housing. The main thing to be noticed in this patent is that the metal shell is a two piece shell which must be secured together by deforming the eyelets at each end thereof. Another example may be found in U.S. Pat. Nos. 3,879,099 and 4,062,616 in which flange portions of the two piece connector shell are crimped together. Another example of a metal shell can be found in U.S. Pat. No. 4,192,571. While this latter device is primarily intended as a strain relief, it quite clearly does enclose the end of the cable and the connector could be used for shielding purposes. However, it is again an example of a two piece metal shell which would require joining together. Any multi-part shield would have the potential disadvantage of actually creating a slot antenna should the parts not be completely joined and a gap formed.

An example of the opposite approach to multi-parts is a cast metal part such as shown in U.S. Pat. No. 3,329,925. While this does away with the possibility of creating slot antennae, it is somewhat cumbersome and is expensive to produce. It is also not cost effective from a space saving standpoint.

With the foregoing disadvantages of the prior art in mind, it is therefore the goal of the present invention to overcome these shortcomings by providing a one piece metal stamping having a face plate portion and a pair of connector enclosure shell portions each connected to an opposite side of the face portion by a respective bight. The face portion has an aperture allowing access to the mating face of the connector and can either be planar or have a metal shroud around the periphery of the aperture. The shell portions together define a connector receiving cavity and the shell portions each have depending sidewalls which interfit, in the closed condition, to completely enclose the connector. The shielding of a shielded cable would be electrically and mechanically joined to the subject shell by an externally applied crimp ring. The subject invention is particularly suitable for electrical connectors which are to be subsequently overmolded with a coating of insulative material.

An embodiment of the present invention will now be described by way of example with reference to the accompanying drawings in which.

Figure 1:
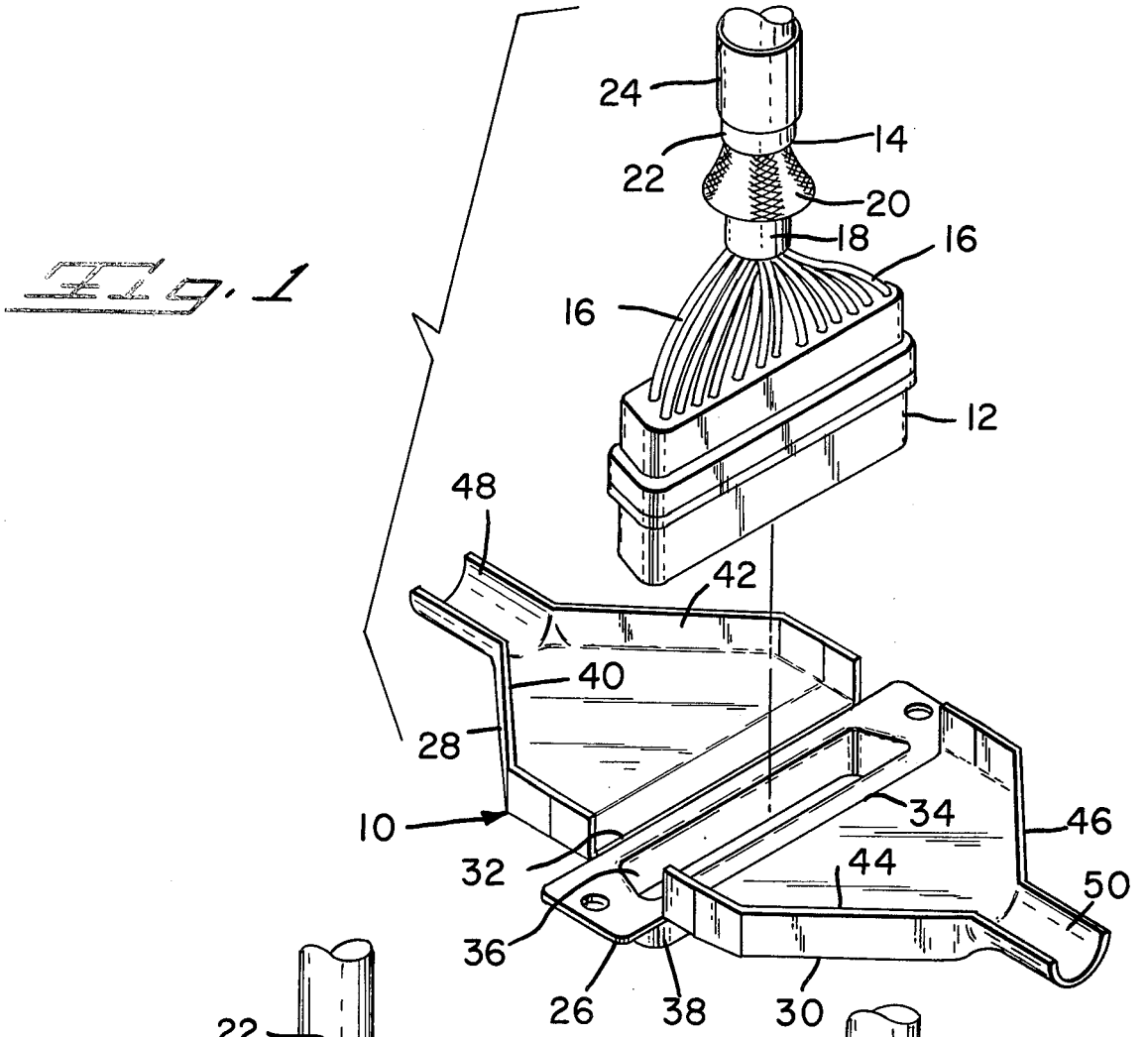
FIG. 1 is a perspective view of the subject shell in an open condition and with a terminated connector exploded therefrom.

The subject one piece metal shell 10 is used in conjunction with an electrical connector 12 of known configuration, such as those shown in U.S. Pat. Nos. 3,879,099; 4,062,616; and 4,200,350, terminating the end of a cable 14. The subject shell would, of course, replace the metal housings of these prior devices. The cable is of the type having a plurality of conductors 16 enclosed in an insulating sleeve 18 which in turn is enclosed in a shielding layer 20 and an outer insulating jacket 22. A crimp ring 24 is provided on the cable prior to effecting the termination with the connector.

Figure 4:
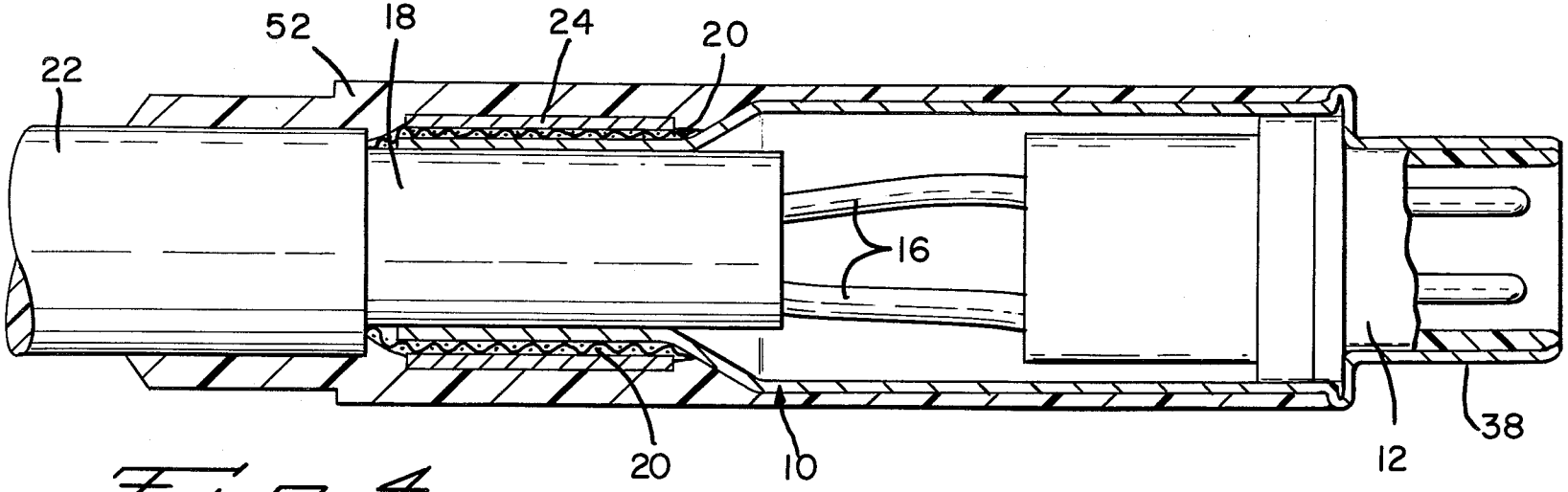
FIG. 4 is a transverse section taken along line 4—4 of FIG. 3.

The subject shell is a unitary member stamped and formed from a continuous piece of stock metal material and has a central face portion 26 with a pair of side shell portions 28, 30 joined to opposite sides of the face portion by bights 32, 34. The face portion 26 includes a central aperture 36 which exposes the mating face of the connector 12. This face portion 26 can also include a peripherial shroud 38 around the aperture 36, as best seen in FIG. 4. The face portion 26 is of sufficient length to provide mounting flanges and apertures at the opposite ends thereof. The side shell portions 28, 30 each include interfitting wall flanges 40, 42, 44, 46, and semicylindrical neck portions 48, 50.

Figure 2:
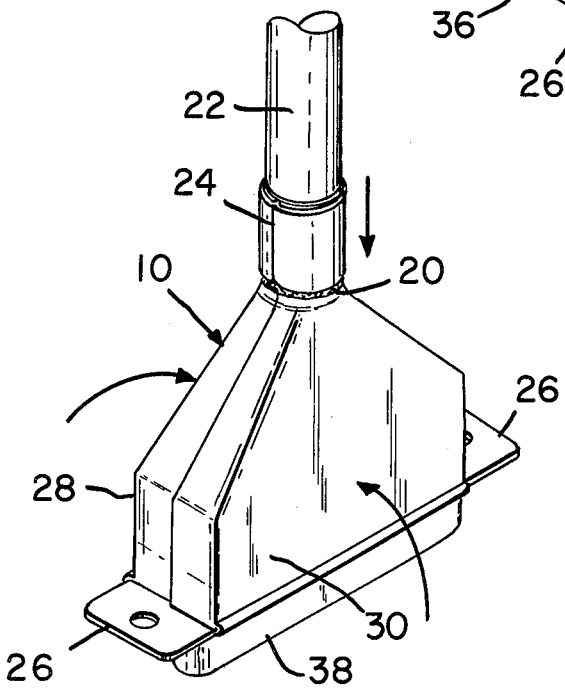
FIG. 2 is a perspective view of the shell of FIG. 1 after it has been closed around the connector.

The present invention is applied to the terminated connector 12 by first inserting the connector 12 mating face into the aperture 36 and then simply folding the side shell portions 28, 30 together, as shown in FIG. 2, bringing the wall flanges into an interfitting condition. This is best effected by forming a slight crimp along the bights 32, 34, as best seen in FIG. 4, which will serve to hold the side shell portions in the closed configuration. The shielding layer 20 of the cable would then be extended down over the neck portions 48, 50 and the crimp ring 24 slipped in place and crimped. This will serve to keep the shell members together while making the necessary mechanical and electrical contact between the cable shield and the shell.

Figure 3:
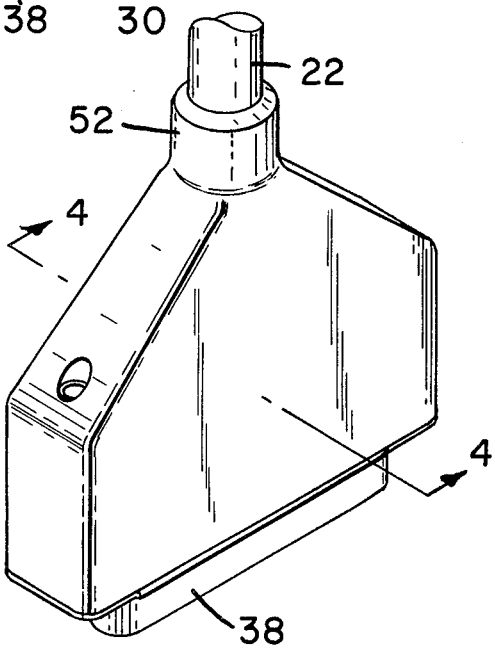
FIG. 3 is a perspective view, similar to FIG. 2, showing the terminated and enclosed connector after overmolding.

The subject invention is best utilized with an overmolding application. FIG. 3 shows the connector and shell of FIG. 2 after an overmolding operaton with the entire outer rear portion of the shell enclosed in a molded insulative layer 52. It will also be appreciated from FIG. 4 that the crimp formed at the bights 32, 34 will aid in this overmolding operation by forming somewhat of a dam against unwanted flow of the insulating material onto the mating face of the connector.

Figure 6:
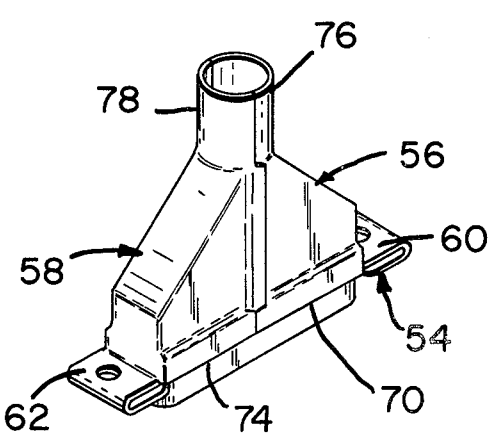
FIG. 6 is a perspective view of the alternate embodiment of FIG. 5 in a closed condition.
Figure 5:
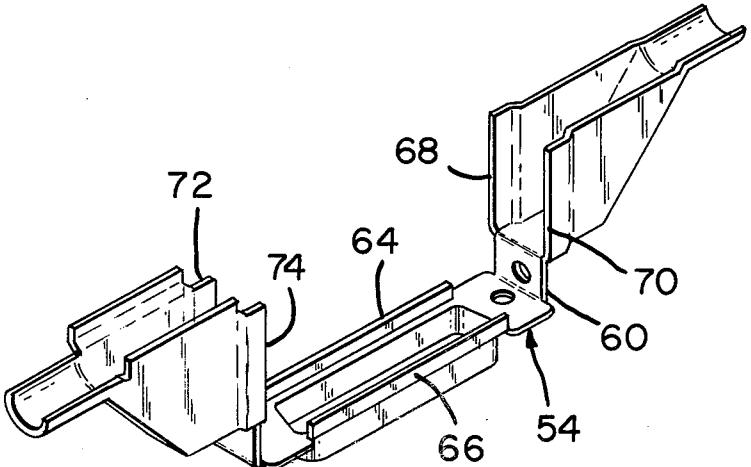
FIG. 5 is a perspective view of an alternate embodiment of the present invention in an open condition.

An alternative embodiment of the subject invention is shown in FIGS. 5 and 6 and differs from the previously described embodiment primarily in the attachment of the shell portions to the face portion. In this embodiment the face portion 54 is essentially the same as the face portion 26. However, the side shell portions have been replaced by end shell portions 56, 58 which are functionally the same as the side shell portions 28, 30 but are dimensionally different. Each end shell is connected to the face portion by respective bights 60, 62. The face portion 60 also includes rearwardly directed side flanges 64, 66 while the end shells each include side flanges 68, 70, 72, 74 and mating neck portions 76, 78.

The assembly of this embodiment on a terminated connector would be the same as previously described. The end shells 56, 58 would simply be closed over the connector and crimped into place as shown in FIG. 6, with portions of the flanges thereof overlapping.

It should be noted that when the side shell portions or the end shell portions are brought into conjunction there is an overlap of the respective edge portions thereof to assure that no slot antenna, as previously described, will be created.

We claim:

1. A metal shell for providing RF-EMI shielding for an electrical connector, said shell having a face portion and a pair of shell portions, said face portion having an aperture exposing the mating face of said connector, said shell portions having interfitting depending side walls and a semi-cylindrical cable engaging neck, characterized by said shell portions being connected to opposite sides of said face portion by respective bights, said shell portions being brought together with said side walls interfitting to enclose said connector and cable.

2. A metal shell according to claim 1 wherein said bights are crimped to hold said shell portions together.

3. A metal shell according to claim 1 further comprising a shroud extending from said face portion and enclosing the aperture therein.

4. A metal shell according to claim 1 further comprising mounting flanges extending from opposite ends of said face portion.

5. A metal shell according to claim 1 wherein said shell portions are connected to opposite sides of said face portion.

6. A metal shell according to claim 1 wherein said shell portions are connected to opposite ends of said face portion.

7. In combination with an electrical connector terminating a shielded multi-conductor cable, a one piece enclosure providing RF-EMI shielding for the connector and grounding of the cable shielding, said enclosure comprising:

a unitary metallic member having a face portion and a pair of shell portions each connected to opposite sides of the face portion by respective bights, said face portion having an aperture therein exposing a mating face of said connector, each shell portion including depending side flanges and a semi-cylindrical cable engaging neck, said shell portions, when folded along said bights, coming into close proximity with said side flanges in overlapping wiping engagement.

8. The combination of claim 7 further comprising a crimp ring applied to said cable to electrically and mechanically engage the shielding thereof to said enclosure.

9. The combination of claim 7 further comprising a shroud extending from said face portion and enclosing said aperture.

10. The combination of claim 7 wherein said bights are crimped to hold said shells together.

11. The combination of claim 7 further comprising an overmold of insulative material.

12. The combination of claim 7 wherein said shell portions are connected at opposite ends of said face portion.

13. The combination of claim 7 further comprising mounting flanges extending from said face portion.

14. A method of providing RF-EMI shielding for an electrical connector terminating a shielded multi-conductor cable comprising the steps of:

stamping a unitary shielding member from metal stock, said member having a face portion with an aperture therein and a pair of shell portions each connected to an opposite side of said face portion by a respective bight, said shell portions having depending sidewalls and a semi-cylindrical cable engaging neck;

placing a terminated connector in said member with the mating face of said connector exposed through said aperture in said face portion;

closing said shell portions about said connector.

15. A method according to claim 14 further comprising the step of crimping said member along said bights to hold said shell portions together.

16. A method according to claim 14 further comprising the step of applying a crimp ring to electrically and mechanically secure shielding of said cable to said neck.

17. A method according to claim 14 further comprising the step of overmolding said connector and shielding member with an insulative material.

* * * * *